United States Patent [19]

Hager et al.

[11] Patent Number: 4,726,782

[45] Date of Patent: Feb. 23, 1988

[54] ANTI-DECOUPLING DEVICE FOR AN ELECTRICAL CONNECTOR

[75] Inventors: Jeffrey J. Hager, Port Hueneme; Arthur Foy, Ben Lomand, both of Calif.

[73] Assignee: G & H Technology, Inc., Santa Monica, Calif.

[21] Appl. No.: 690

[22] Filed: Jan. 5, 1987

[51] Int. Cl.[4] ..... H01R 13/623

[52] U.S. Cl. ..... 439/321

[58] Field of Search ..... 339/89 R, 89 C, 89 M, 339/90 R, 90 C, DIG. 2; 439/312–323

[56] References Cited

U.S. PATENT DOCUMENTS

| | | | |
|---|---|---|---|
| 3,594,700 | 7/1971 | Nava et al. | 339/89 R |
| 4,030,798 | 6/1977 | Paoli | 339/DIG. 2 |
| 4,165,910 | 8/1979 | Anderson | 339/89 M |
| 4,588,245 | 5/1986 | Schwartz et al. | 339/89 R |

FOREIGN PATENT DOCUMENTS

| | | | |
|---|---|---|---|
| 2042822 | 9/1980 | United Kingdom | 339/89 M |

*Primary Examiner*—John McQuade

*Attorney, Agent, or Firm*—George J. Netter

[57] ABSTRACT

The inner end surface of the outer end portion of an electrical connector coupling ring has a set of teeth extending circumferentially about the coupling ring. A metal ring has a bore sufficient to enable it being received onto the connector plug and an outer diameter sufficient to enable receipt within the coupling ring and allow the coupling ring to rotate thereabout. One or more keyways on the decoupling ring are interlocked with keys on the connector plug maintaining the antidecoupling ring and plug in fixed relationship to one another, irrespective of movement of the coupling ring. At least one elongated leaf spring has an end formed into a detent that rides along and between the coupling ring teeth. The other spring end is rotatably located on a pivot pin mounted to the circumferential periphery of the anti-decoupling ring.

7 Claims, 9 Drawing Figures

ANTI-DECOUPLING DEVICE FOR AN ELECTRICAL CONNECTOR

FIELD OF THE INVENTION

The present invention relates generally to releasable electrical connectors employing a coupling ring for mating and unmating the electrical connector, and, more particularly, to an improved device for preventing inadvertent decoupling of such a connector as a result of shocks and vibrations acting on the connector.

BACKGROUND

Releasable connectors are used in a great many situations, both domestically and in the aerospace field, where it is necessary or advisable to be able to quickly couple and decouple the connector. However, it is equally desirable that when such connectors are mated or coupled they remain in that condition until affirmatively disconnected or unmated, and not be loosened or inadvertently unmated completely as a result of vibrational or shock forces to which they may be subjected.

One prior art approach to preventing inadvertent decoupling has been to provide interlocking splines on one of the connector parts and a coupling sleeve or coupling ring which surrounds the connector part. Other approaches which are closer in concept to that disclosed herein include spring members which contact with the connector parts, hindering decoupling. Examples of these are U.S. Pat. No. 2,784,385 and 3,784,966, the latter using a spring element which engages one of several recesses.

All known prior systems, including those referenced immediately above, have not been completely satisfactory in that they are either difficult and expensive to make, readily subject to failure during operation, or for other reasons found to be unreliable.

SUMMARY OF THE INVENTION

Although the anti-decoupling device to be described may find advantage in use with other electrical connectors, it is particularly advantageous when employed with a releasable electrical connector including a coupling ring which is rotated to effect mating or unmating, depending upon the direction of rotation. More particularly, the coupling ring consists of a metal shell which is received over one of the connector parts (the plug) and rotates relatively therewith in order to drive the plug and receptacle connector parts together or apart, depending upon the direction of rotation.

The inner end surface of the outer end portion of a coupling ring includes a set of teeth extending circumferentially completely about the coupling ring. The decoupling device consists of a metal annulus having a bore sufficient to enable it being received onto the connector plug and having an outer diameter sufficient to enable being received within the coupling ring and allowing the coupling to rotate thereabout. One or more keyways on the decoupling ring are interlocked with complementary keys on the connector plug maintaining the anti-decoupling ring and plug in fixed relationship to one another, irrespective of movement of the coupling ring. One or more elongated leaf springs has both of its ends rolled up forming generally cylindrical end portions. One end of the spring is rotatably located on a pivot pin mounted in the circumferential periphery of the anti-decoupling ring.

In assembly, the anti-decoupling ring is positively located on the connector plug with the leaf springs being wrapped about the anti-decoupling ring periphery so that the coupling ring may be positioned thereover. The free ends of the springs act as detents which are positioned within the teeth on the inner wall of the coupling ring providing a positive positioning force on the coupling ring so that it can only be rotated to release the connector parts by the exertion of a predetermined amount of tortional force between the coupling ring and the other connector parts.

The leaf spring free end (detent) on moving from one tooth to another during mating and unmating produces a "click" which can be sensed both audibly and tactilely.

Also, on unmating each spring bows outwardly increasing the amount of force needed to unmate the connector, and, in that way, insuring against inadvertent connector release. During connector mating, the spring, more or less, flattens out toward the plug shell teeth making the rotative force necessary for mating substantially less than that for unmating.

DESCRIPTION OF THE PREFERRED EMBODIMENT

Figure 1:
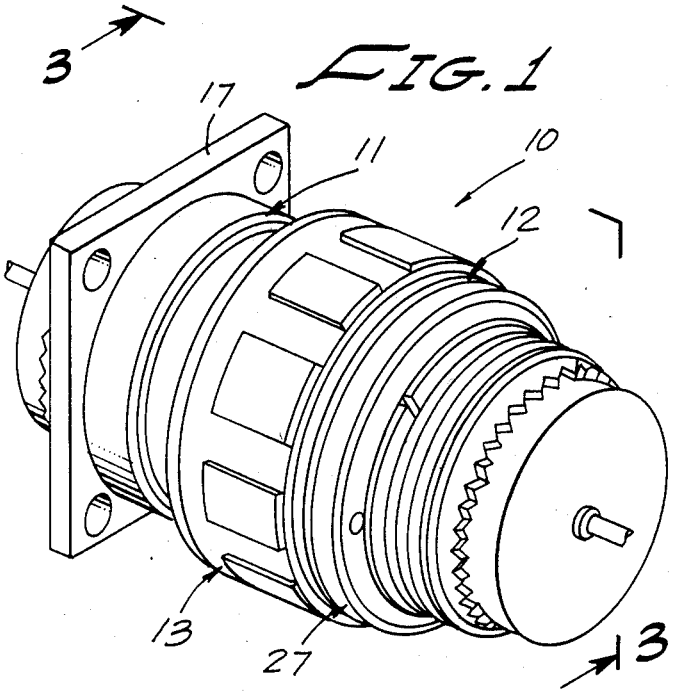
FIG. 1 is a perspective view of an electrical connector with which the anti-decoupling device of the present invention is most advantageously employed.
Figure 3:
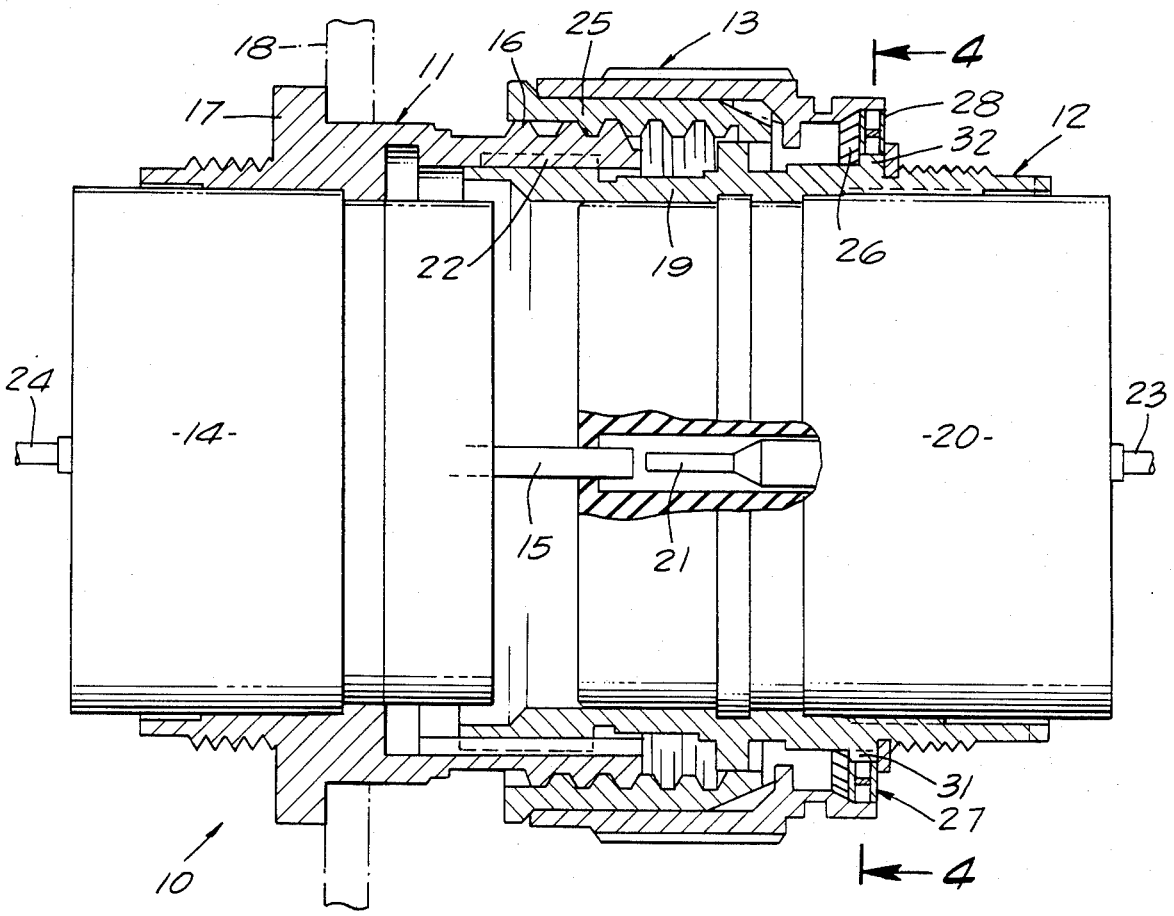
FIG. 3 is a side elevational, sectional view taken along line 3—3 of FIG. 1.

Referring now to the drawings, and particularly FIGS. 1 and 3, the electrical connector with which the anti-decoupling device of the present invention derives its primary utility is depicted generally as at 10. The electrical connector broadly includes a receptacle 11, a plug 12 and a coupling ring 13 rotatably secured to the plug for mating or unmating the receptacle and plug, depending upon the direction of rotation.

The receptacle 11 consists generally of a hollow, metal, cylindrical shell within which is located an insulative insert 14 for carrying one or more contacts, such as the socket contact 15. The outer surface of the forward end which mates with the plug, in a way to be more particularly described, includes a set of threads on its outer surface at 16. Although the construction can vary somewhat from connector to connector, typically an enlarged flange 17 is provided for mounting to a suitable wall surface 18, for example.

The plug 12 consists of a hollow, generally cylindrical metal tube 19 having forward end parts which can be slidingly received within the receptacle open end. A set of insulative inserts identified as 20 are included within the plug bore for carrying one or more electrical contacts, such as a pin contact 12. One or more keys 22 on the outer surface of the plug shell are received within a corresponding keyway formed in the inner surface of the receptacle shell 11 to properly orient the plug and receptacle when mated for appropriately engaging the contacts 15 and 21 which, in turn, interconnect cable wires 23 and 24, as desired.

The coupling ring 13 includes a cylindrical, hollow metal shell of such dimensions as to enable receipt over the plug shell and to permit relative rotation thereabout. That is, the coupling ring is fixed with respect to longitudinal movement relative to the plug, but can be rotated thereabout. A nut 25 includes an inwardly directed set of threads of such pitch and diameter as to mesh with the threads 16 on the receptacle 11. The nut is so mounted as to provide relatively resilient movement with respect to the coupling ring, but is otherwise fixed such that the coupling ring and nut will revolve as a unit. Rotation of the coupling rings and included nut acts to either pull the plug and receptacle together (mating) or to separate the two connector parts (unmating), depending upon the direction of rotation.

Figure 4:
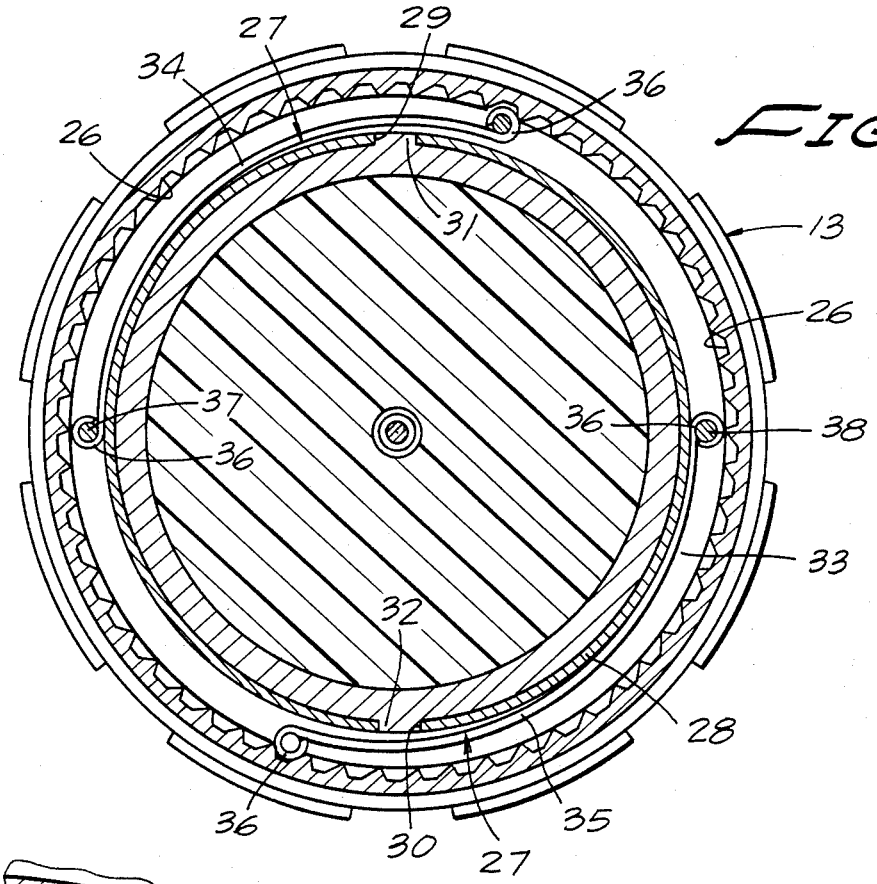
FIG. 4 is an end elevational, sectional view taken along the line 4—4 of FIG. 3 showing the antidecoupling device in operative relationship to the other connector parts.

The rear end surface of the coupling ring 13 (i.e., the end opposite that which receives the receptacle) is provided with a circumferentially extending set of gear teeth 26 (FIG. 4). These teeth, as will be described in detail later, contact with an anti-decoupling device for providing a resilient force holding the coupling ring in a fixed angular position with respect to the plug shell. In this way, the plug shell is prevented from being rotated in a direction to uncouple or unmate the connector parts as a result of mere vibration or shocks. Also, as will be shown, rotation in the opposite direction (i.e., in a direction to mate the connector parts) encounters a lesser amount of force, thereby making mating of the connector part easier.

Figure 2:
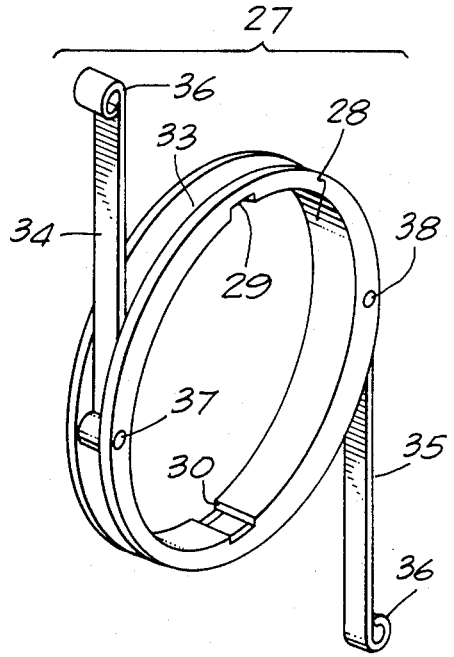
FIG. 2 is a perspective view of the antidecoupling ring of the invention shown separately and removed from the connector apparatus.

For the ensuing description of the antidecoupling device enumerated generally as 27, reference is now made especially to FIG. 2. As shown there, it includes an annular base 28, the internal diameter of which enables receipt upon the back end portion of the plug shell. One or more keyways, such as the pair of keyways 29 and 30, receive corresponding keys 31 and 32 on the outer surface of the plug shell when the device is received thereon, which secures the anti-decoupling base 28 against rotative movement with respect to the plug shell. Side plates extend radially outwardly to form a circumferentially extending passage 33, which opens radially outwardly.

At least one detent spring, such as preferably first and scond detent springs 34 and 35, consists of an elongated rectangular flat spring, the end portions of which are rolled on the same side of the spring to form generally cylindrical detent members 36. A pin 37 passes through one of the rolled ends 36 of the spring 34 and also through accommodating openings in the sidewalls of the base 28, which define the passage 33. In this manner the spring 34 has one end thereof secured to the base 28 and lies within the passage 33. Similarly, the spring 35 has its one end secured within the passage 33 by a pin 38 located substantially 180 degrees from the pin 37 and with the spring extending in the opposite direction. The diameter of this cylindrically formed spring end portion 36 is sufficient to enable being received between threads or teeth in the set of teeth 26 on the coupling ring (FIG. 4).

Although the anti-decoupling device 27 has been described and depicted as having two springs 34 and 35, it is considered within the contemplation of this invention to use only one such spring or more than two. Where the connector is relatively small requiring correspondingly smaller mating/unmating forces, only one spring is needed to deter inadvertent connector release. On the other hand, for a large connector (e.g., 6 inch diameter), three such springs may be advisable to insure against inadvertent release.

Figure 5:
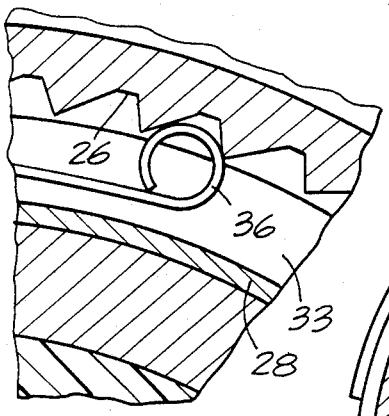
FIG. 5 is an enlarged fragmentary view showing the detailed engagement of a spring end within a coupling ring tooth.

In assembly, the annular base is slid onto the back end of the plug shell 19, locating the keyways 29 and 30, respectively, on the keys 31 and 32, and simultaneously forcing the free ends of the springs 34 and 35 into the base passage 33. This locates the anti-decoupling base 28 and springs 34 and 35 within the end portion of the coupling ring which simultaneously locates each of the free formed ends 36 of the springs within the space between adjacent teeth 26 (FIGS. 3 and 4). As can be seen best in FIG. 5, the sides of the teeth 26 are sloped differently. Thus, the one side of a tooth of the set of teeth 26 is at a relatively large angle as measured against a radial whereas the immediately adjacent slope of the same tooth is at a relatively smaller angle, and this is repeated throughout the entire set of teeth.

Figure 6:
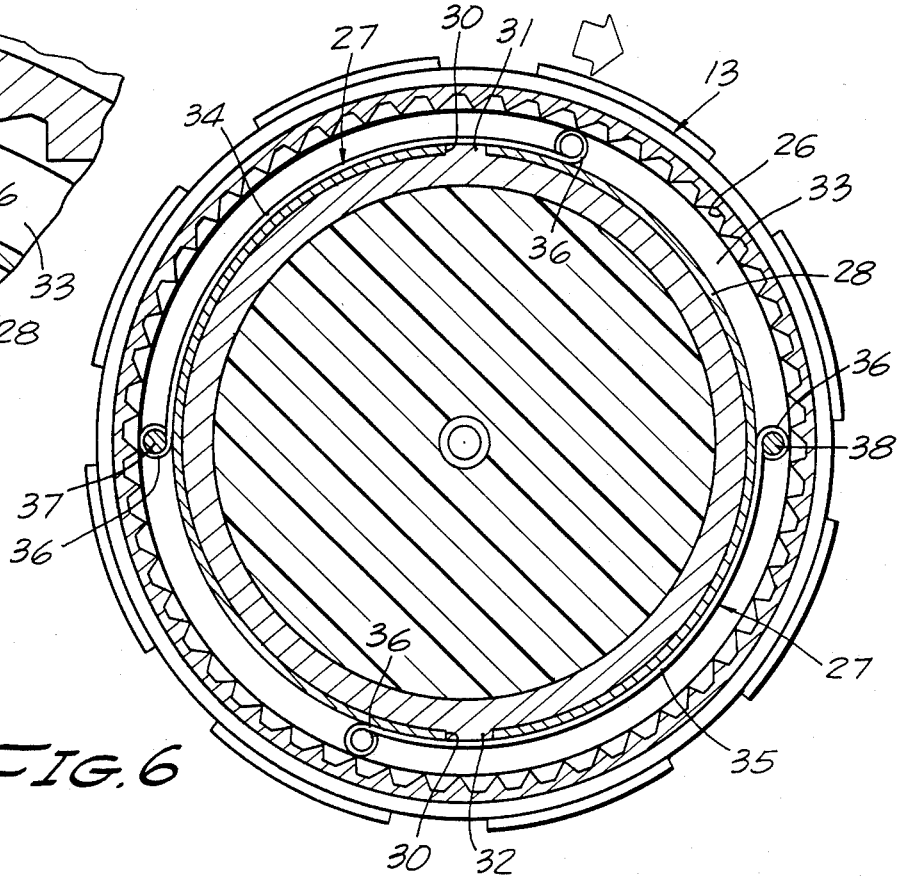
FIG. 6 is an end elevational, sectional view similar to FIG. 4 showing the anti-decoupling device midway in advancement in the mating direction between adjacent detenting positions.

As can be seen best in FIG. 6, when the coupling ring is rotated in a direction to mate the connector parts, the rolled free end of the springs will move along a relatively shallow slope of the teeth to the top of the tooth and then down into the valley of the next tooth. This will continue as long as the coupling ring is rotated in the mating direction. However, on attempting to move the coupling ring in the unmating direction, the same rolled free ends of the springs will now have to move up a relatively steeper side of each tooth, providing substantially more resistance to the unmating action of the coupling ring.

Figure 7:
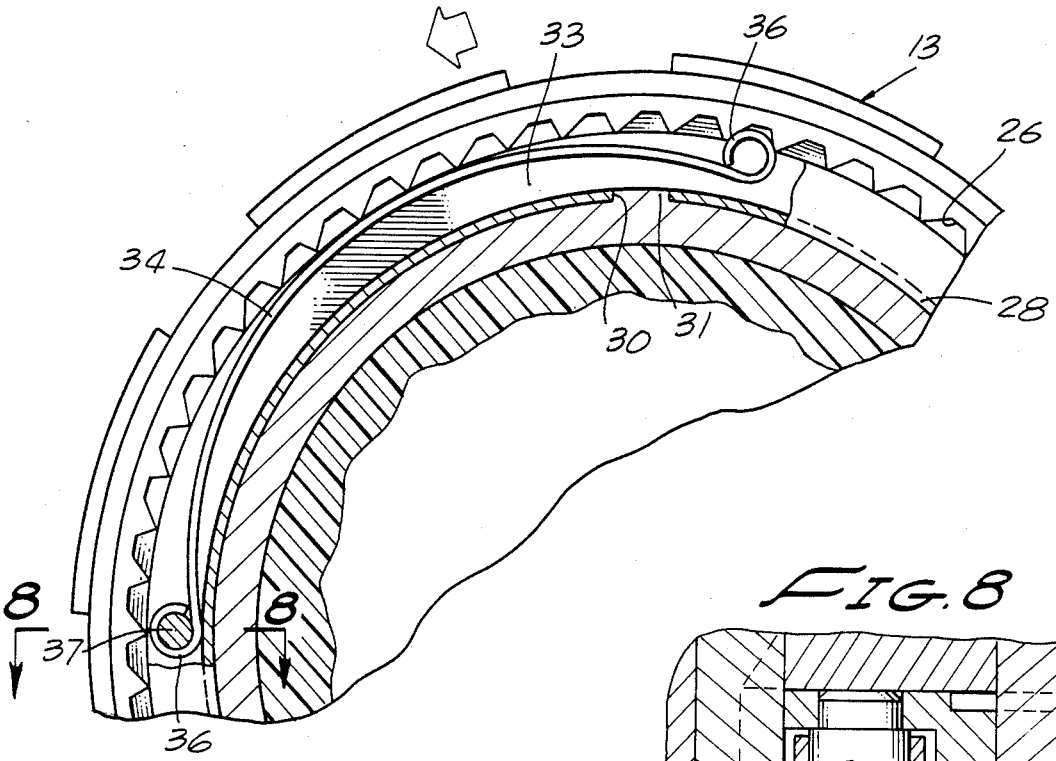
FIG. 7 is an end elevational, sectional partially fragmentary view showing the anti-decoupling device resisting unmating.
Figure 8:
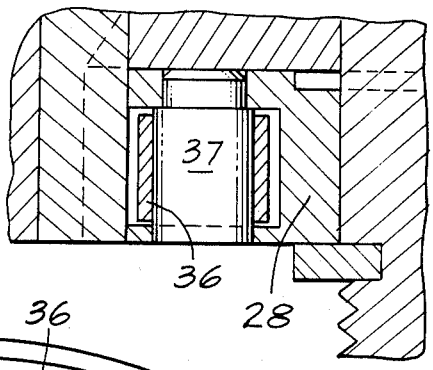
FIG. 8 is a top plan, sectional view taken along the line 8—8 of FIG. 7.
Figure 9:
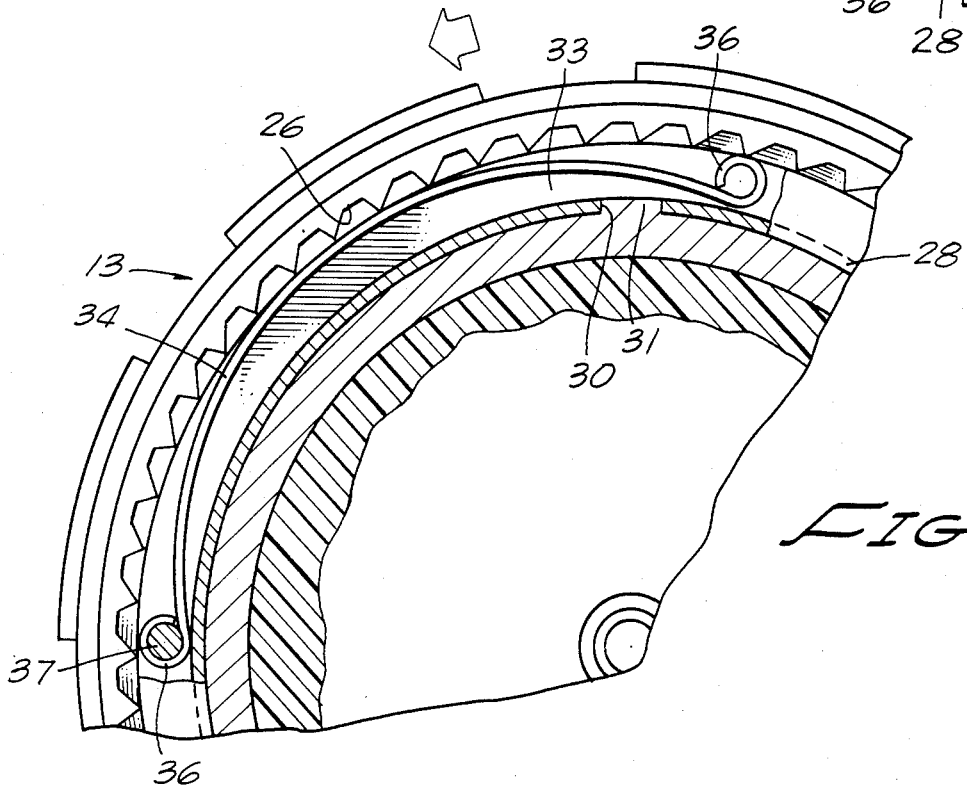
FIG. 9 is an end elevational, sectional, partially fragmentary view similar to FIG. 7 showing the anti-decoupling device at the moment of experiencing that amount of force necessary to effect an unmating rotation.

In addition to the effect of the teeth slope on rotation resistance, the anti-decoupling springs will provide different resistance forces to the two rotation directions. For example, when the coupling ring is rotated to mate the connector as shown in FIG. 6 this flattens the spring onto the plug shell outer surface moving the spring and portion 36 out of engagement with the teeth 26 with the application of a relatively small amount of force. Rotating the coupling to unmate the connector as in FIGS. 4 and 7 bows the spring producing a relatively large force tending to keep the connector mated.

In either mating or unmating, each time the rolled spring end 36 moves from one tooth to the next an audible and tactilely sensed "click" is produced.

We claim:

1. Apparatus deterring relative rotation of a cylindrical coupling shell of an electrical connector with respect to a cylindrical connector part, said coupling shell being telescopingly and rotatably received about said connector part, comprising:

circumferentially extending set of teeth formed on a rear end portion of the coupling shell;

an annular base fixedly received on the connector part located spaced from and directly opposite the set of teeth, said annular base having a peripheral surface including first and second radially extending side walls forming an outwardly opening circumferential passage; and an elongated detent leaf spring having one free end portion and one end affixed to the outer circular peripheral surface of the annular base by a pivot pin secured to the base side walls, the spring lying generally along the annular base periphery with the free end of the spring riding on the set of teeth and exerting reaction spring pressure between the coupling shell and connector part retarding relative rotation thereof.

an annular base fixedly received on the connector part located spaced from and directly opposite the set of teeth, said annular base having a peripheral surface including first and second radially extending side walls forming an outwardly opening circumferential passage; and an elongated detent leaf spring having one free end portion and one end affixed to the outer circular peripheral surface of the annular base by a pivot pin secured to the base side walls, the spring lying generally along the annular base periphery with the free end portion of the spring riding on the set of teeth and exerting reaction spring pressure between the coupling shell and connector part retarding relative rotation thereof.

2. Apparatus as in claim 1, in which key and keyway means interconnect the annular base and connector part preventing relative rotation therebetween.

3. Apparatus as in claim 1, in which the free end portion of said spring is formed into a cylindrical detent of dimensions suitable to enable said detent to rest within a space between adjacent teeth.

4. Apparatus as in claim 1, in which first and second detent springs are affixed to the annular base at separate points angularly spaced from one another at approximately 180 degrees and extending about the annular base in the same direction.

5. Apparatus deterring relative rotation of a cylindrical coupling shell of an electrical connector with respect to a cylindrical connector part, said coupling shell being telescopingly and rotatably received about said connector part, comprising:

circumferentially extending set of teeth formed on a rear end portion of the coupling shell, said teeth each being canted in the same direction so that the formed free end portion of the detent spring encounters steeper teeth sides when the coupling shell is rotated in one direction about the connector shell than when it is rotated in the opposite direction;

an annular base fixedly received on the connector part located spaced from and directly opposite the set of teeth, said annular base having a peripheral surface including first and second radially extending side walls forming an outwardly opening circumferential passage; and an elongated detent leaf spring having one free end portion and one end affixed to the outer circular peripheral surface of the annular base by a pivot pin secured to the base side walls, the spring lying generally along the annular base periphery with the free end portion of the spring riding on the set of teeth and exerting reaction spring pressure between the coupling shell and connector part retarding relative rotation thereof.

6. Apparatus as in claim 5, in which first and second detent springs are affixed to the annular base at separate points angularly spaced from one another approximately 180 degrees and facing in the same direction about the annular base.

7. Apparatus as in claim 5, in which key and keyway means interconnect the annular base and connector part preventing relative rotation therebetween.

* * * * *